US006907908B1

(12) United States Patent
Weldy

(10) Patent No.: US 6,907,908 B1
(45) Date of Patent: Jun. 21, 2005

(54) HOPPER APPARATUS AND METHOD FOR APPLICATION OF JOINT COMPOUND TO CORNER BEADS

(75) Inventor: Derrell J. Weldy, Campo, CA (US)

(73) Assignee: Pla-Cor Incorporated, Santee, CA (US)

( * ) Notice: Subject to any disclaimer, the term of this patent is extended or adjusted under 35 U.S.C. 154(b) by 0 days.

(21) Appl. No.: 10/836,872

(22) Filed: Apr. 30, 2004

(51) Int. Cl.[7] ..... B65B 1/04

(52) U.S. Cl. ..... 141/67; 141/1; 141/98; 118/404; 118/DIG. 2

(58) Field of Search ..... 141/1, 67, 98, 141/129; 118/404, 405, 429, 407, 415, DIG. 2

(56) References Cited

U.S. PATENT DOCUMENTS

| | | | | |
|---|---|---|---|---|
| 163,825 | A * | 5/1875 | Wallick | 118/405 |
| 2,570,379 | A | 10/1951 | Robinson | |
| 4,259,379 | A | 3/1981 | Britton et al. | |
| 4,398,690 | A | 8/1983 | Rutledge | |
| 5,169,449 | A | 12/1992 | Raught | |
| 5,242,495 | A | 9/1993 | Hammond et al. | |
| 5,676,793 | A | 10/1997 | Martin et al. | |

OTHER PUBLICATIONS

Pla-Cor, Inc. Convertible Hopper Advertisment, Jun. 1995.

* cited by examiner

*Primary Examiner*—Steven O. Douglas
(74) *Attorney, Agent, or Firm*—Gordon & Rees LLP

(57) ABSTRACT

A hopper apparatus for applying joint compound to corner beads has a hopper for holding a quantity of joint compound and a feeder apparatus secured across the lower end of the hopper. The feeder apparatus has a channel and a series of elongate feeder inserts for selectively securing in the channel. A first set of outside feeder inserts each have a generally V-shaped indented groove extending along their length for guiding an outside corner bead through the feeder apparatus, while a second set of inside feeder inserts each have a generally V-shaped ridge extending along their length for guiding an inside corner bead through the feeder. The feeder inserts in each set have grooves and ridges of different angles and corner shapes matching those of a plurality of different inside and outside corner beads, and are releasably secured in the channel.

24 Claims, 8 Drawing Sheets

HOPPER APPARATUS AND METHOD FOR APPLICATION OF JOINT COMPOUND TO CORNER BEADS

BACKGROUND OF THE INVENTION

The present invention relates generally to drywall construction and is particularly concerned with a hopper apparatus and method for applying drywall mud or joint compound to corner beads or tape-on-trims prior to their attachment to joints or corners between adjacent drywall panels.

Corner beads are elongate, narrow strips of metal, plastic, or metal with a paper face on one side, or the like folded or angled along their longitudinal center line, or along a line offset from the center line in some cases, to produce a generally v-shaped cross-section. They are made in various angles and corner shapes, including sharp 90 degree angle corners, sharp corners at other angles, rounded or so-called "bullnose" corners of various angles, and offset or L-shaped corners. Corner beads are also designed for covering both inside (concave) and outside (convex) corners. For application to an inside corner, drywall mud is applied to the outside (convex) faces of an inside corner bead. For application to an outside corner, drywall mud is applied to the inside (concave) faces of an outside corner bead. Joint compound is applied to the appropriate faces of the bead, and the bead is then pressed against the corner, with the joint compound forming an adhesive joint between the bead and corner.

Although drywall mud or joint compound may be applied to corner beads by hand, this is a time consuming and inconvenient process. Hopper devices have been proposed in the past for applying joint compound to the inside faces of an outside corner bead. One such apparatus is described in U.S. Pat. No. 5,169,449 of Raught. The apparatus comprises a hopper with a V-shaped trough in its base, and triangular shaped end walls at opposite ends of the trough forming a generally V-shaped gap between the lower edge of each end wall and the trough. Removable end panels are adjustably secured to the end panels to adjust the height of the gap. A corner bead is fed through the base of the hopper from one end wall opening to the opposite end wall opening, and drywall mud in the hopper will be applied to the upwardly facing surfaces of the corner bead. All except a thin layer will be scraped off by the edge of the end panel as the corner bead exits the hopper. Removable liners may be placed into the hopper to define different trough cross-sectional shapes, corresponding to different shapes of corner bead, and associated with end panels with corresponding edge shapes.

The Convertible Hopper manufactured by Pla-Cor Incorporated, of Santee, Calif. has an open base across which a feeder is secured, the feeder having a V-shaped trough for receiving an outside corner bead. Removable panels or gates are secured to opposite end walls of the hopper for forming a V-shaped inlet and outlet opening with the opposing surface of the feeder at opposite ends of the feeder. The feeder can also be adjusted for different shapes of outside corner bead, by placing a feeder insert comprising a generally V-shaped trough over the main feeder. This requires removal of the feeder from the hopper, placement of the feeder insert over the feeder, and re-attachment of the feeder insert and feeder to the hopper. This hopper apparatus is designed to be converted between 90 degree corner beads, ¾ inch bullnose, and 1½ inch bullnose corner beads.

One problem with prior art hoppers having corner bead feeders for applying joint compound is that they can only be used for outside corner beads, i.e. corner beads that are applied over outside, or convex, corners in a building. However, a large number of the corner joints between adjacent drywall panels are inside corners. Up to now, there has been no effective and accurate means to apply drywall mud to inside corner beads.

SUMMARY OF THE INVENTION

It is an object of the present invention to provide a new and improved hopper apparatus and method for application of drywall mud or joint compound to corner beads.

According to one aspect of the present invention, a hopper apparatus for applying joint compound to corner beads is provided, which comprises a hopper for holding joint compound having an open upper end and a lower end, a feeder apparatus secured across the lower end of the hopper, the feeder apparatus comprising a tray or channel, a series of elongate feeder inserts for selectively securing in the tray, and a releasable fastener device for releasably securing a selected one of the feeder inserts in the tray. The feeder inserts comprise a first set of inserts each having a V-shaped indented cross section for guiding an outside corner bead under the lower end of the hopper with the concave face of the corner bead facing upwardly and a second set of inserts each having an inverted V-shaped cross section with the V-shape having an apex facing upwardly.

This arrangement permits the same basic hopper and feeder apparatus to be used to coat the surfaces of both inside and outside corner beads. A series of end gates may be provided for selectively securing to the hopper above the respective ends of the selected feeder insert in the tray, each end gate having a lower edge shaped to match the cross-section of a respective feeder insert such that the lower edge of the end gate and upper face of the feeder insert together form a V-shaped or inverted V-shaped end slot for receiving a corner bead as it is fed through the feeder apparatus, the end gates including a first set of end gates having a convex V-shape with a downwardly directed apex for use with the first set of feeder inserts and a second set of end gates having an indented V-shape with an upwardly directed apex for use with the second set of feeder inserts.

The first and second sets of feeder inserts and associated end gates will be provided in a plurality of different angles and corner shapes, including sharp angled corners and rounded, bullnose corners. In this way, a single hopper and feeder apparatus can be used for an entire range of inside and outside corners, simply by removing and replacing the feeder insert and end gates each time a new corner bead is to be coated with joint compound.

In an exemplary embodiment of the invention, the feeder apparatus is secured beneath the hopper and the lower end or bottom wall of the hopper has an opening for supplying joint compound to the feeder apparatus. The feeder apparatus may have a pair of spaced vertical side walls and the tray is a generally U-shaped channel member secured between the upper ends of the side walls. The entire apparatus is secured to the bottom wall of the hopper. The tray or channel member has a flat base spaced from the bottom wall of the hopper, and interchangeable insert members with flat lower faces can be selectively positioned in the tray and releasably secured to it so that the selected insert member extends lengthwise between the end walls of the hopper and beneath the opening in the hopper bottom wall. Therefore, rather than having to remove the entire base feeder apparatus from the hopper every time a new feeder insert is to be used, all that is necessary is to release the previously installed feeder insert from the tray, slide it out, and slide in a new feeder insert before securing it in position in the base of the tray. Any suitable releasable fastener devices may be used to secure the selected feeder insert in the tray, such as bolts or the like.

In an exemplary embodiment of the invention, first and second sets of flexible panels are provided for selectively securing at opposite ends of the channel above the selected feeder insert and between the respective end gate and an end wall of the hopper, the first set of generally rectangular flexible panels having at least a first end edge with a convex, V-shaped projection, each first end edge angle and shape matching the angle and shape of respective feeder inserts of the first set, and a second set of generally rectangular flexible panels having at least a first end edge with an upwardly directed, generally V-shaped indent, the first end edge angle and shape of each flexible panel of the second set matching the angle and shape of respective feeder inserts of the second set. The flexible panels are positioned such that their end edges protrude slightly below the corresponding end edge of the matching end gate and into the end slot of the feeder apparatus, and the end edges will scrape excess drywall mud off the corner bead as it exits the feeder apparatus. Each flexible panel may have a second end edge opposite the first end edge of matching angle and shape to the first end edge. This allows the panel to be reversed when the first end edge becomes worn due to the abrasive effects of the drywall mud or joint compound. The end edges of the flexible panels may be serrated.

According to another aspect of the present invention, a hopper apparatus is provided, which comprises a hopper having an open upper end, a lower wall, opposite side walls, and opposite end walls, and an interior for holding a quantity of joint compound, the lower wall of the hopper having an opening, and a feeder apparatus secured beneath the lower wall of the hopper, the feeder apparatus comprising a generally rectangular, elongate channel having a flat base wall, the channel extending between opposite ends of the lower wall of the hopper, and a plurality of different elongate feeder inserts for selectively mounting in the channel for guiding corner beads of different angles and shapes through the channel. Each feeder insert has an upwardly facing surface of different cross-sectional shape from the other feeder inserts, and a flat lower portion for seating against the flat base wall of the channel, and a fastener device is provided for releasably securing a selected feeder insert in the channel. The apparatus further comprises a plurality of end gates for releasably securing to the opposite end walls of the hopper above opposite ends of the channel, each end gate having a lower edge shaped to match the cross-section of the upwardly facing surface of a respective feeder insert, whereby the lower edge of the end gate and the upper face of the selected feeder insert together form a slot of shape matching the cross-sectional shape of a selected corner bead for guiding the corner bead through the feeder apparatus with upper faces of the corner bead facing the opening in the lower wall of the hopper, such that joint compound flowing through the opening into the channel will be deposited on the upwardly facing surfaces of the corner bead.

This apparatus allows drywall mud or joint compound to be applied quickly and easily either to the inside faces of an outside corner bead, or the outside faces of an inside corner bead, and allows joint compound to be applied to any shape of corner bead using the same basic apparatus, only requiring changing out of a feeder insert and end panels to accommodate any new inside or outside corner shape or angle. The hopper apparatus can be converted quickly and easily to coat inside or outside corner beads of various shapes and angles, simply by removing and replacing the feeder insert and associated end gates and panels. This will make corner finishing of drywall joints faster and more efficient, and will reduce equipment costs, since only one basic hopper apparatus is required.

BRIEF DESCRIPTION OF THE DRAWINGS

The present invention will be better understood from the following detailed description of an exemplary embodiment of the invention, taken in conjunction with the accompanying drawings in which like reference numerals refer to like parts and in which.

DETAILED DESCRIPTION OF THE DRAWINGS

Figure 1:
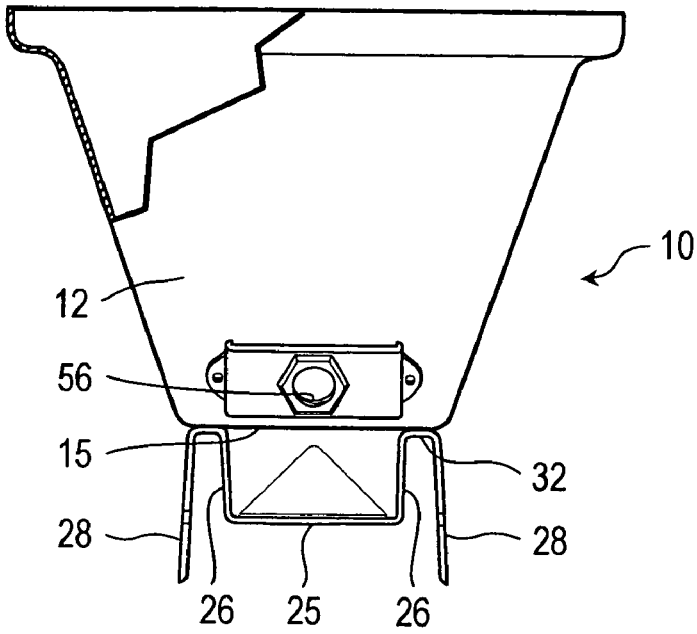
FIG. 1 is an end elevation view, partly broken away, of a hopper apparatus according to an exemplary embodiment of the present invention.
Figure 2:
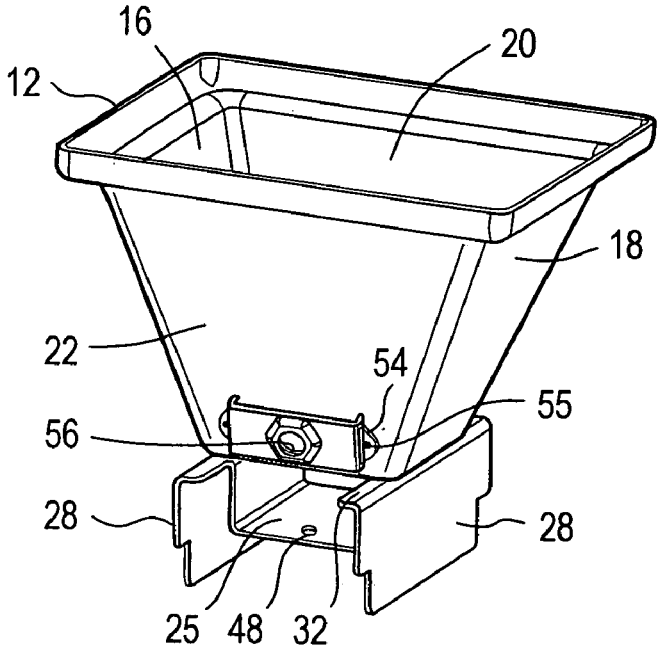
FIG. 2 is a perspective view of the hopper apparatus of FIG. 1.

FIGS. 1 to 14 illustrate a hopper apparatus 10 for applying drywall mud or joint compound to corner beads of various shapes and sizes. The basic hopper apparatus is illustrated in FIGS. 1 to 6, and comprises a hopper or bucket 12 and a base feeder apparatus 14 secured across the lower wall 15 of the hopper. The hopper is of plastic or similar material and has an open upper end, spaced side walls 16,18, and spaced end walls 20,22. An elongate opening 24 is provided in the lower wall of the hopper for supplying drywall mud from the hopper into the feeder apparatus below.

The feeder apparatus 14 includes a base having a generally rectangular feeder tray or channel having a base wall 25 and spaced side walls 26, and a pair of outer side support walls 28 spaced outwardly on each side of the channel. The side support walls are designed for seating on top of a bucket or a raised stand, as described in my co-pending application entitled "Hopper Stand", which was filed on even date herewith, the contents of which are incorporated herein by reference. The feeder base is secured to the bottom wall of the bucket via bolts 30 which extend through openings in the bottom wall 15 and aligned openings in the upper rims 32 of the base on each side of the channel. When secured to the hopper, the channel runs between the opposite end walls 20,22 of the hopper and beneath the elongate opening 24.

Figure 6:
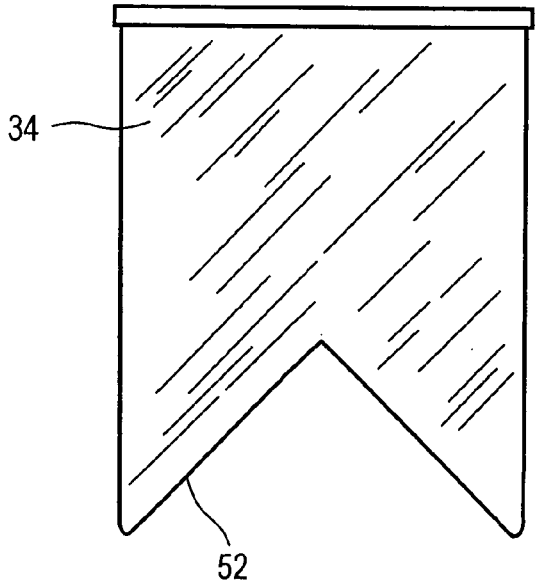
FIG. 6 is a top plan view of an end gate for use in the feeder apparatus.
Figure 7:
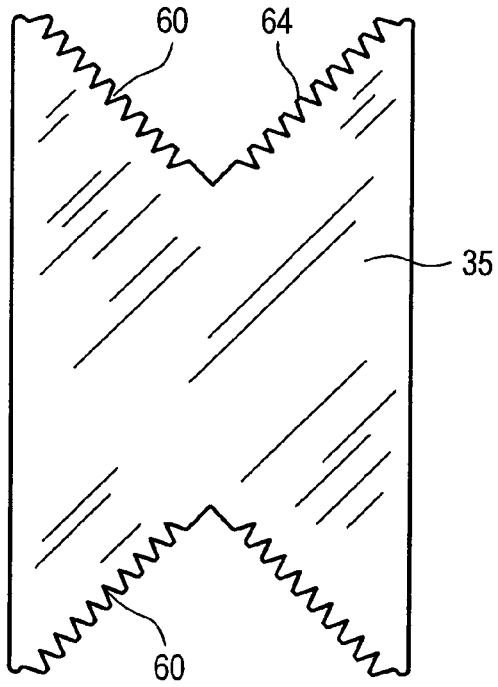
FIG. 7 is a top plan view of a flexible end panel for use with the end gate of FIG. 6.
Figure 8A:
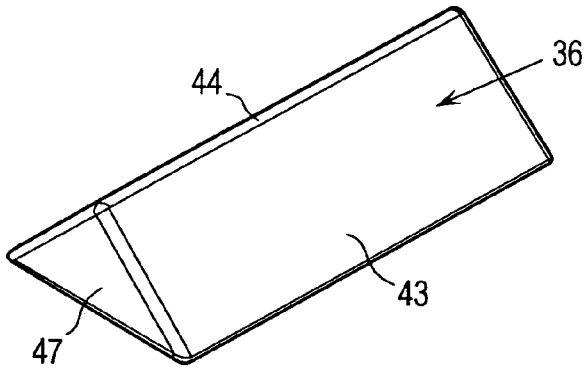
FIG. 8A is a top perspective view of an inside feeder insert for use in the hopper apparatus of FIGS. 1 to 5 together with the end gate and end panel of FIGS. 6 and 7.
Figure 8B:
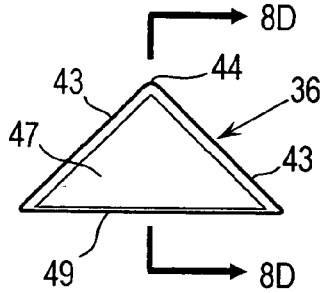
FIG. 8B is an end elevation view of the feeder insert of FIG. 8A.
Figure 8C:
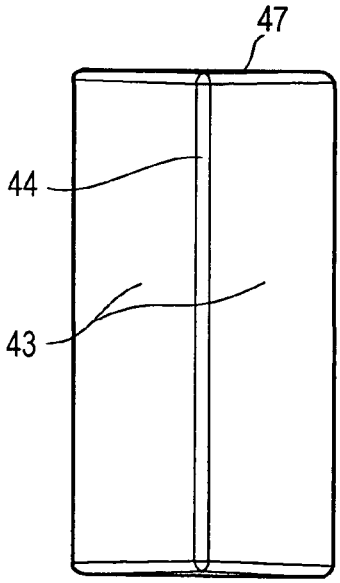
FIG. 8C is a top plan view of the feeder insert of FIGS. 8A and 8B.
Figure 8D:
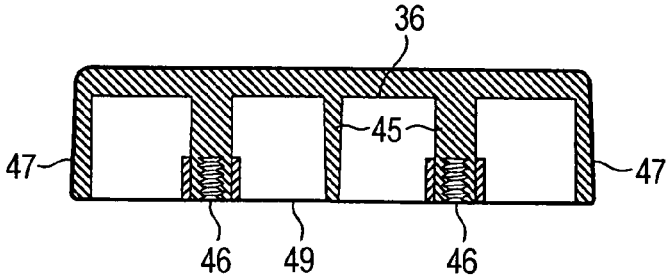
FIG. 8D is a cross-sectional view on the lines 8D—8D of FIG. 8B.

The feeder apparatus further comprises any one of a plurality of feeder inserts, for example any of the feeder inserts illustrated in FIGS. 8, 9 and 12 to 17, which are designed to be releasably mounted in the base wall 25 of the channel, as well as a pair of matching end gates and a pair of matching flexible end panels. One example of an inside feeder insert 36 and matching end gate 34 and panel 35 is illustrated in FIGS. 6,7 and 8, and the same components are shown mounted on the hopper and feeder channel in FIGS. 3 and 4. The feeder insert 36 of FIGS. 8A to 8D, and the matching end gate 34 and panel 35 are designed for guiding a 90 degree inside corner bead 38 through the feeder apparatus so as to coat a layer 40 of mud onto the outer or convex faces 42 of the bead, as will be described in more detail below.

Figure 3:
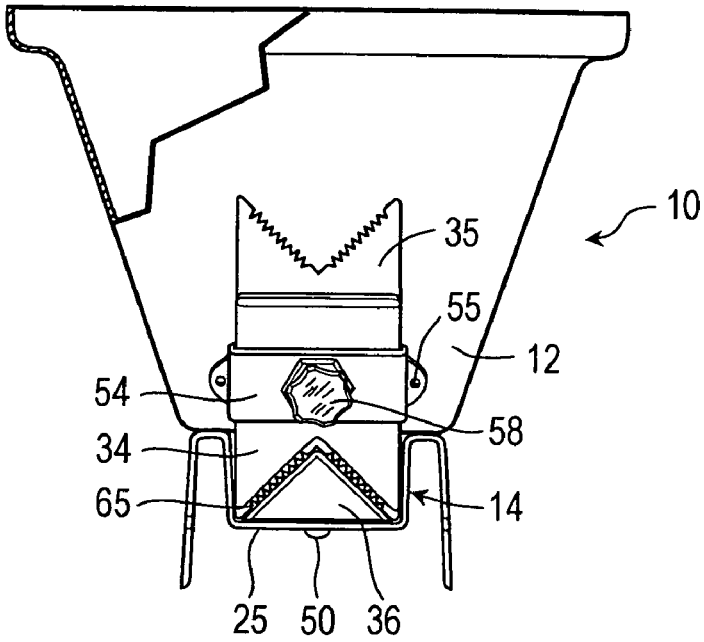
FIG. 3 is an end elevation view similar to FIG. 1, illustrating a selected feeder insert and matching end panel and gate installed in the feeder apparatus for guiding a drywall tape or corner bead through the feeder apparatus beneath the hopper.
Figure 4:
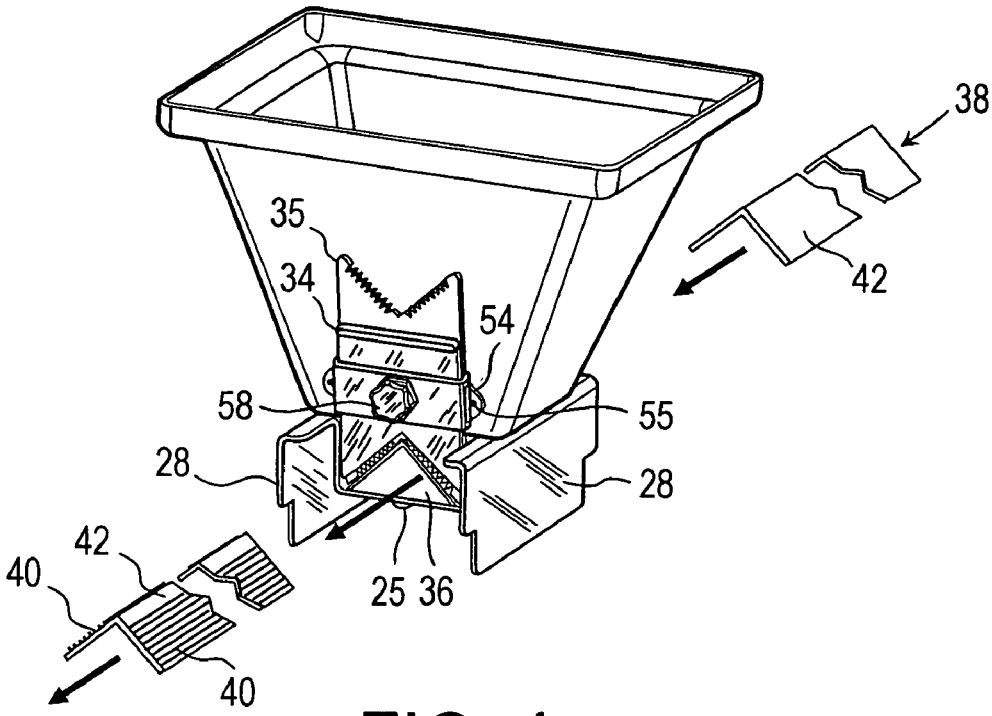
FIG. 4 is a perspective view similar to FIG. 3 schematically illustrating the feeding of a corner bead through one end of the feeder apparatus and drywall mud applied to the bead when it exits at the opposite end of the feeder apparatus.
Figure 5:
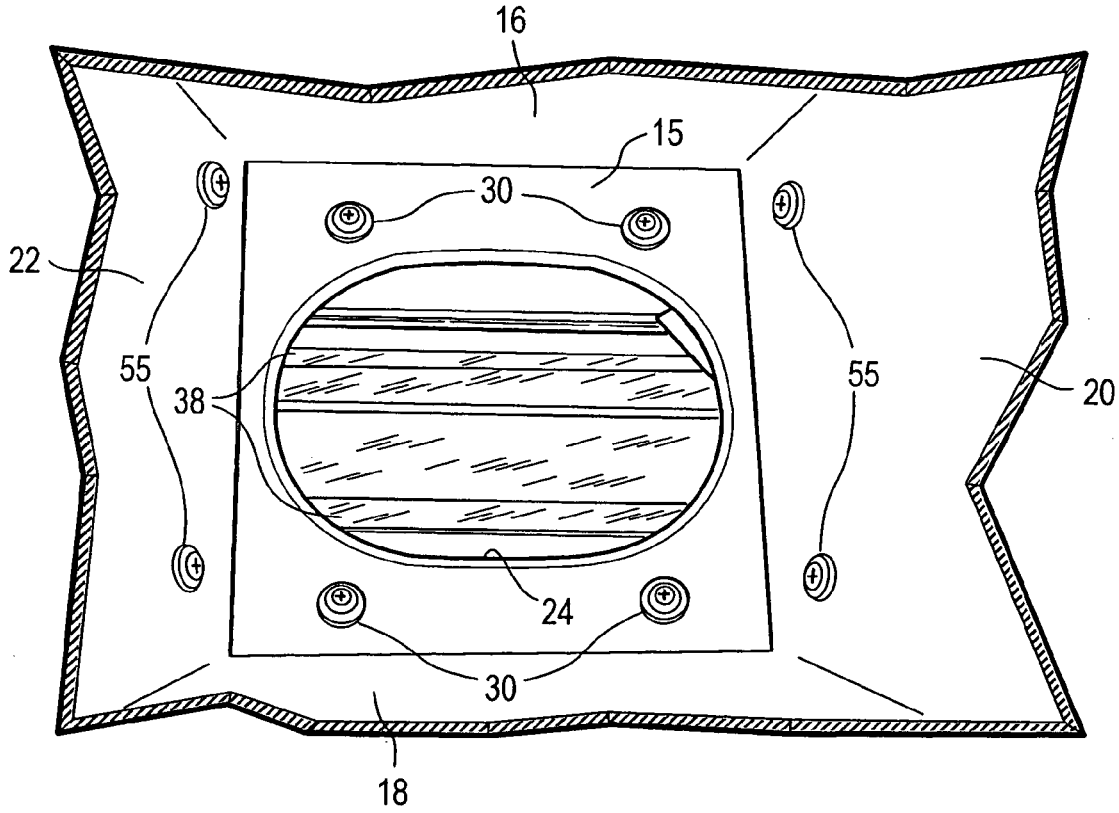
FIG. 5 is a top plan view, partially broken away, of the bottom wall of the hopper with the feeder apparatus beneath.

The feeder insert 36 is an elongate member of generally V-shaped or triangular vertical cross section having an apex or ridge 44 extending along its length, the apex forming a relatively sharp, 90 degree angle, as best illustrated in FIGS. 8A to 8D. The insert has opposite side walls 43 and end walls 47, and a flat lower face or lower portion 49. It may be formed of plastic material or the like, and may be a solid rectangular block with a flat lower wall. However, in the exemplary embodiment, in order to save material, the insert is generally hollow, with an open lower face. Transverse webs 45 are provided in the hollow interior of the insert, with at least two of the webs having centrally located, threaded bores 46 at their lower ends. The lower edges of the side walls, end walls, and webs of the insert together define a flat end face 49 of the insert for seating against the flat base wall of the channel. The base wall 25 of the channel has openings 48 positioned for alignment with the bores 46 when the insert is positioned in the channel as shown in FIGS. 3 and 4. Fastener screws 50 extend through the openings 48 and into the threaded bores 46 in order to secure the insert 36 in position. Although the insert is secured in the channel via bolts or screws extending through the base of the channel in the illustrated embodiment, other fastener devices may be used in alternative embodiments, such as spring loaded clamping jaws or snap lock formations in the base of the channel itself, or a mating groove and projection arrangement, with the insert sliding in from one end of the channel so as to engage the groove or projection, which may have snap locking devices to releasably hold the insert in position in the channel.

Each end gate 34 has a lower edge comprising an indented V-shape 52 of matching angle to the apex 44 of the feeder insert 36, as best illustrated in FIGS. 3 and 6. A pair of rigid end gates 34 are mounted at the opposite end walls 20,22 of the hopper such that the V-shaped indent 52 faces downwardly and is located above the apex of the feeder insert. A generally U-shaped mounting bracket 54 is secured to each end wall via bolts 55 (see FIGS. 1,2 and 5), to form a mounting slot between the outer face of the respective end wall and the bracket. A threaded central bore 56 is provided in each bracket, for engagement with a matching threaded clamping bolt 58 to secure the end gate in a selected position, as indicated in FIGS. 3 and 4. A pair of matching, flexible end panels 35 of rubber material or the like are provided for mounting behind the respective end gates. As best illustrated in FIG. 7, each flexible end panel 35 has a matching V-shaped indent 60 at each end, which is a sharp angle of 90 degrees matching the indent on the end gate 34, as well as the angle of the apex 44 of the feeder insert, as indicated in FIGS. 6,7 and 8. The edges of the indents 60 are serrated to form sharp teeth 64 for scraping excess mud off the corner bead, as will be described in more detail below. Drywall mud or joint compound is relatively abrasive, so that the serrated scraper edge of the flexible end panel, which is normally made of rubber or the like, will become worn relatively rapidly. The lifetime of the flexible end panel is doubled by providing a scraper edge at both ends of the panel, such that the panel can simply be inverted when the first end edge becomes worn.

Once the selected feeder insert 36 has been installed in the channel of the feeder apparatus, the matching end gates and end panels will be mounted on the opposite end walls of the hopper, by inserting them through the slot formed by each end bracket 54. The gate and end panel are lowered until they are at the desired spacing from the insert 36, with the serrated edge 64 of indent 60 projecting below the edge 52 of end gate 34, as illustrated in FIGS. 3 and 4. This forms a V-shaped inlet or outlet feed slot 65 for guiding the corner bead. The bolts 58 are then tightened until the ends of the bolts bear against the end gate to secure the end gate and panel in position. Unlike prior art arrangements, the end panels in this case have no openings or slots to receive a bolt or screw fastener projecting through the mounting bracket, but the bolt ends simply bear against the end panels, providing a greater range of height adjustment.

Once the feeder apparatus is assembled with the desired feeder insert, end gate, and end panel which match the shape of the corner bead 38, the hopper 12 can be filled with drywall mud, and the corner bead 38 is fed into the feeder apparatus through the end slot 65 at end wall 20, in the direction of the arrow in FIG. 4. It will be understood that the assembly of the feeder insert, matching end gate, and matching end panel at the end wall 20 will be identical to that illustrated in FIGS. 3 and 4 for the end wall 22. The corner bead will engage over the feeder insert 36 and will be guided along the insert and out through the end slot 65 at the opposite end of the feeder apparatus. At this point, the corner bead can be pulled through the feeder apparatus until a desired length of the bead has been coated. Drywall mud in the hopper will fall down through opening 24 and onto the upwardly facing surfaces 42 of the corner bead. As the corner bead is pulled out through the slot 65 at the opposite end of the feeder apparatus, excess mud will be scraped off by the teeth 64, leaving a thin layer 40 of drywall mud coating the outer faces of the bead. The corner bead is then ready to be applied to an inside corner joint between adjacent drywall panels.

Corner beads are made for both inside corners and outside corners, and in various angles and corner shapes. Inside corner beads are of generally v-shaped, convex cross section, i.e. the outer faces of the beads are designed to be placed against adjacent faces of an inside corner joint. Outside corner beads are of generally v-shaped, concave cross section, i.e. the inner or concave faces of the beads are designed to be placed against adjacent faces of an outside corner joint. In addition to V-shaped inside and outside corner beads, there are also L-shaped or offset corner beads. Both inside and outside corner beads are made in various shapes, sizes and angles to fit against corners of a corresponding variety of shapes and angles. The hopper apparatus 10 will be provided with a corresponding variety of inside and outside feeder inserts and matching end gates and end panels, so that the hopper apparatus can be readily adapted for applying mud to the surfaces of any desired inside or outside corner bead. FIGS. 9 and 12 to 14 are some examples of different feeder inserts for use with different types of corner beads.

Figure 9A:
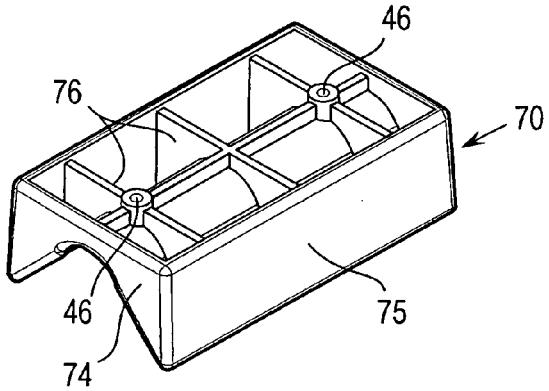
FIG. 9A is a bottom perspective view of an outside feeder insert for use in the hopper apparatus of FIGS. 1 to 5.
Figure 9B:
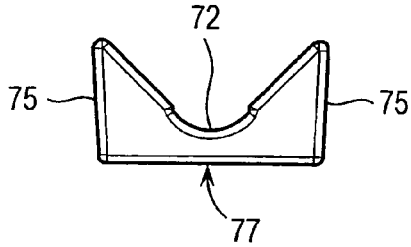
FIG. 9B is an end elevation view of the feeder insert of FIG. 9A.
Figure 9C:
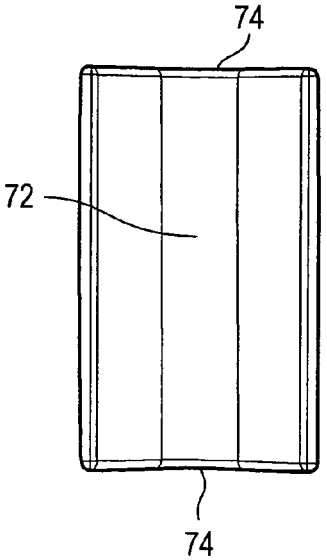
FIG. 9C is a top plan view of the feeder insert of FIGS. 9A and 9B.
Figure 10:
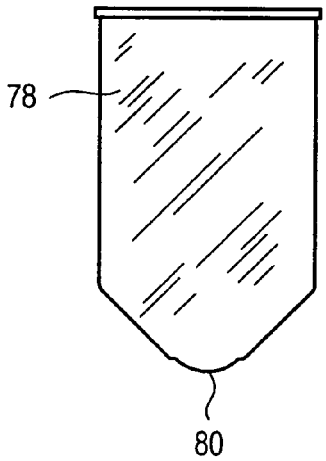
FIG. 10 is a top plan view of an end gate for use with the outside feeder insert of FIGS. 9A to 9C.
Figure 11:
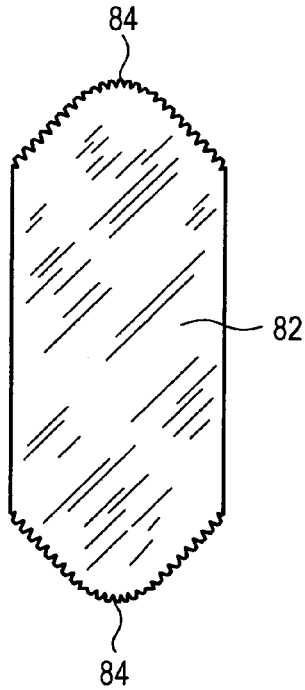
FIG. 11 is a top plan view of a flexible end panel for use with the end gate of FIG. 10.

FIGS. 9A to 9C illustrate an outside feeder insert 70 of similar hollow construction to the inside feeder insert 36, but having an upper face comprising a generally V-shaped indent or channel 72 rather than a V-shaped ridge or protrusion. Again, the insert 70 is an elongate member with opposite end walls 74 and side walls 75, and an open lower face 77 with a hollow interior, as best illustrated in FIG. 9A. Transverse strengthening webs 76 are provided across the interior of the insert, and, as in the case of the inside feeder insert 70, a pair of downwardly facing threaded bores 46 are provided at the center of two of the webs, for securing the insert 70 in the base of the feeder channel with screws 50. The feeder insert 70 is for a 90 degree bullnose corner bead, and has a rounded or bullnose shape rather than a sharp angled shape. It will be understood that matching end gates and end panels will be provided for use with the 90 degree bullnose outside insert 70, as illustrated in FIGS. 10 and 11. FIG. 10 illustrates an end gate 78 which is similar to end gate 34 of FIG. 6 but which has a lower end comprising a 90 degree bullnose projection 80 rather than an indent. Similarly, FIG. 11 illustrates a flexible end panel 82 of rubber or the like which is similar to the end panel 35 of FIG. 6 but has a 90 degree bullnose projection 84 at each end. When the outside insert 70 is mounted in the channel of the feeder apparatus in place of insert 36, and an end gate 78 and end panel 82 are secured at each end of the hopper via mounting bracket 54 and bolt 55, a V-shape inlet and outlet slot will be provided between the opposing faces of the feeder insert and end gate and panel at each end of the feeder apparatus. The slot will be of a shape generally matching that of a 90 degree bullnose outside corner bead. The corner bead can then be fed through the feeder apparatus with its inner or concave faces facing upwardly to be coated with mud, and the mud will be scraped off to a desired layer thickness by the end panel at the exit end of the apparatus.

Figure 12:
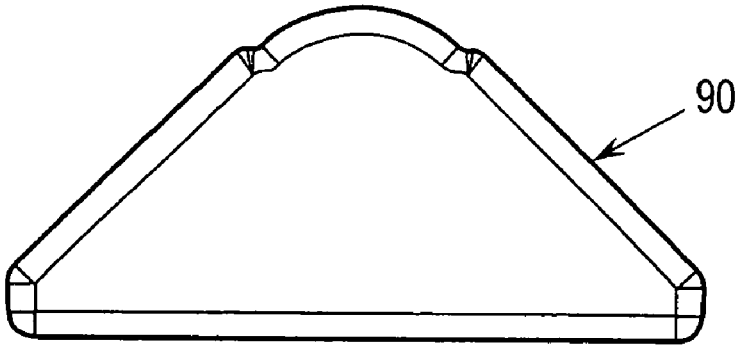
FIGS. 12 to 17 are end elevation views of alternative feeder inserts with different guide face shapes and angles for guiding different inside and outside corner beads through the feeder apparatus.
Figure 13:
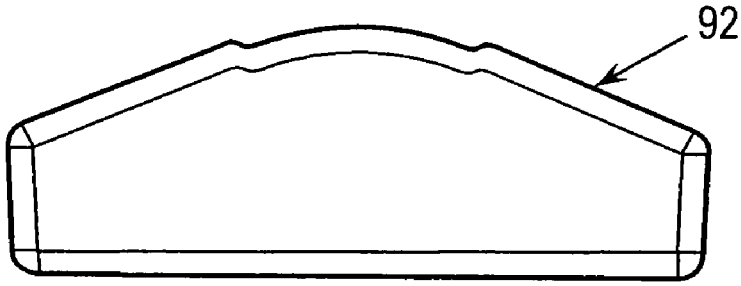
Figure 14:
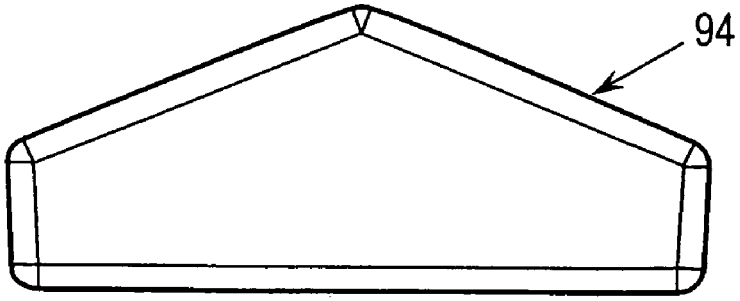
Figure 15:
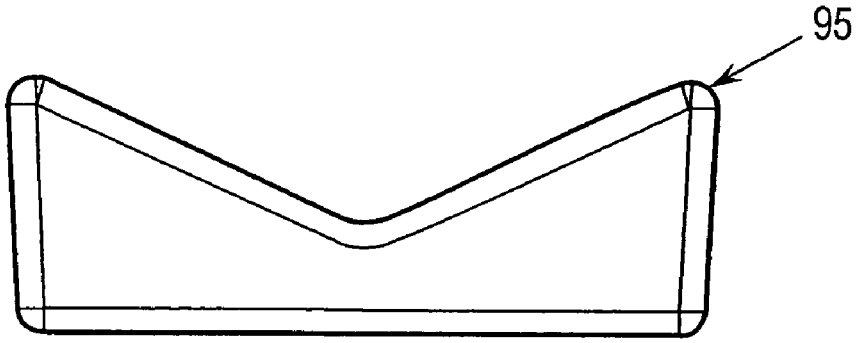
Figure 16:
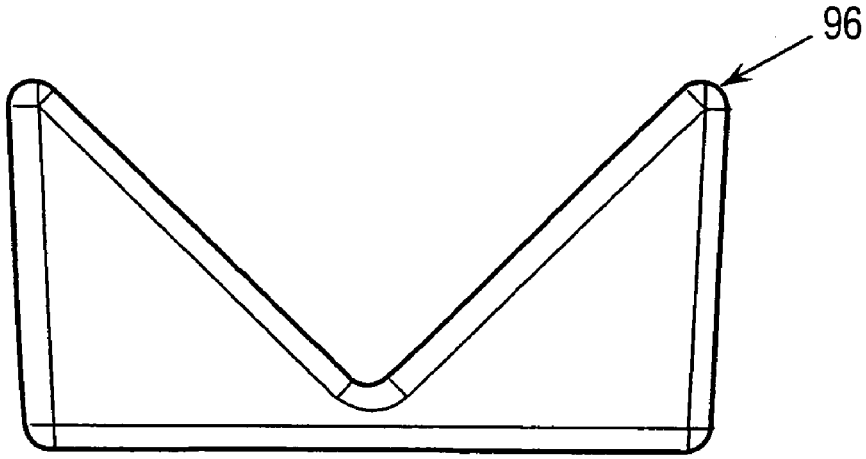
Figure 17:
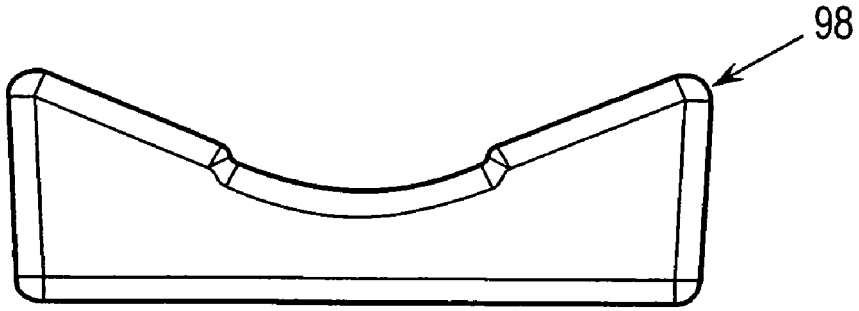

FIGS. 8 and 9 are just two examples of many different possible feeder insert contours, with FIGS. 12 to 17 illustrating some other examples. It will be understood that, for each of the feeder inserts of FIGS. 12 to 17, a corresponding set of end plates and end panels will be provided with mating lower edges, with convex or protruding lower edges for the outside feeder insert and concave or indented lower edges for mating with inside feeder inserts. FIG. 12 illustrates a 90 degree bullnose inside feeder insert 90, while FIG. 13 illustrates a 135 degree bullnose inside feeder insert 92, and FIG. 14 illustrates a 135 degree, sharp corner or standard inside feeder insert 94. FIG. 15 illustrates a 135 degree sharp corner or standard outside feeder insert 95, while FIG. 16 illustrates a 90 degree sharp corner or standard outside feeder insert 96, and FIG. 17 illustrates a 135 degree bullnose outside feeder insert 98.

Although all of the feeder inserts are of hollow construction in the illustrated embodiment, it will be understood that they may alternatively be of solid block construction in alternative embodiments, again with threaded bores positioned for alignment with the holes 48 in the base 25 of the channel. The feeder inserts may be formed of plastic, metal, or equivalent materials. Additionally, although the feeder apparatus is secured beneath the lower wall of the hopper in the illustrated embodiment, with an opening in the hopper lower wall for supplying drywall mud or joint compound into the feeder apparatus, it may alternatively extend through the lower portion of the hopper itself, with openings in the opposite end walls of the hopper and the gates and end panels positioned above the openings, while the feeder insert extends a short distance out through the opposite end walls on each side to provide the inlet and outlet slots with the opposing end edges of the end gates and end panels.

With the hopper apparatus of this invention, the same feeder apparatus can be modified quickly and easily so that drywall mud can be applied to any type and shape of corner bead, and to both inside and outside corner beads. It will be understood that additional feeder inserts, end plates, and end panels may be provided to cover a wide range of different inside and outside corner bead shapes. All that is required to change to a different type of corner bead is to remove the end gates and panels by loosening one bolt 58 at each end of the hopper, and to remove the current feeder insert by removing two fastener screws 50 from beneath the feeder channel. The new feeder insert is then selected and inserted in the channel and secured in position with the screws, while the matching end gates and panels are secured in the end mounting brackets at the desired position. The height of the end gates and panels may be adjusted for different coating thicknesses. Thus, the hopper apparatus can be modified quickly and easily to accommodate any desired inside or outside corner bead.

Although an exemplary embodiment of the invention has been described above by way of example only, it will be understood by those skilled in the field that modifications may be made to the disclosed embodiment without departing from the scope of the invention, which is defined by the appended claims.

I claim:

1. A hopper apparatus for applying joint compound to corner beads, comprising:

a hopper having an open upper end, a lower end, and an interior for holding a quantity of joint compound;

a feeder apparatus secured across the lower end of the hopper, the feeder apparatus comprising a channel having opposite ends;

a series of elongate feeder inserts for selectively securing in the channel to extend between the ends of the channel for feeding a selected corner bead along the channel, the feeder inserts comprising a first set of outside inserts each having a generally V-shaped indented groove extending along their length for guiding an outside corner bead through the feeder apparatus with the concave face of the corner bead facing the joint compound in the hopper, and a second set of inside inserts each having a generally V-shaped ridge extending along their length with an apex facing the joint compound in the hopper for guiding an inside corner bead through the feeder with the convex face of the corner bead facing the joint compound in the hopper, the feeder inserts in each set having grooves and ridges of different angles and corner shapes matching those of a plurality of different inside and outside corner beads; and at least one fastener device for releasably securing a selected feeder insert in the channel.

2. The apparatus as claimed in claim 1, further comprising a series of end gates for selectively securing at opposite ends of the channel above the selected feeder insert, the end gates comprising a first set of rigid end panels having at least a lower edge with a convex, V-shaped projection, each end panel lower edge angle and shape matching the angle and shape of respective feeder inserts of the first set, and a second set of rigid end panels having at least a lower edge with an upwardly directed, generally V-shaped indent, the lower edge angle and shape of each end panel of the second set matching the angle and shape of respective feeder inserts of the second set, and a releasable securing device at each end of the feeder apparatus for releasably securing a selected end panel to a hopper end wall above the selected feeder insert.

3. The apparatus as claimed in claim 1, wherein each set of inside and outside feeder inserts are provided in a range of different angles, the angles comprising at least 90 degrees and 135 degrees.

4. The apparatus as claimed in claim 1, wherein each set of inside and outside feeder inserts and matching end panels are provided in a range of different corner shapes, the corner shapes comprising sharp angled concave and convex apices and bullnose, rounded concave and convex apices.

5. The apparatus as claimed in claim 2, further comprising a first set of flexible panels for selectively securing at opposite ends of the channel above the selected feeder insert behind the respective end gate, the flexible panels comprising a first set of generally rectangular flexible panels having at least a first end edge with a convex, V-shaped projection, the first end edge angles and shapes matching the angles and shapes of respective end gates of the first set, and a second set of generally rectangular flexible panels having at least a first end edge with an upwardly directed, generally V-shaped indent, the first end edge angles and shapes of the panels of the second set matching the angles and shapes of respective end gates of the second set.

6. The apparatus as claimed in claim 5, wherein each flexible panel has a second end edge opposite the first end edge of matching angle and shape to the first end edge.

7. The apparatus as claimed in claim 1, wherein the lower end of the hopper comprises a bottom wall having an opening and the feeder apparatus is secured beneath the bottom wall of the hopper with the channel having a flat base wall spaced below the bottom wall of the hopper and extending beneath the opening between opposite end walls of the hopper, whereby joint compound is supplied from the hopper onto the feeder apparatus through the opening.

8. The apparatus as claimed in claim 7, wherein each feeder insert has a flat lower portion for seating against the flat base wall of the channel.

9. The apparatus as claimed in claim 7, wherein the feeder apparatus is permanently secured to the hopper bottom wall, and a selected feeder insert is removably secured to the base wall of the channel.

10. The apparatus as claimed in claim 7, wherein the feeder apparatus comprises a one piece base member having a pair of downwardly depending outer side walls for supporting the hopper on top of a bucket or stand, each side wall having an upper, inwardly extending flat rim, and a channel of rectangular cross section extending between the flat rims of the outer side walls, the flat rims being secured to the hopper bottom wall.

11. The apparatus as claimed in claim 2, wherein the releasable securing device for the end gates comprises a mounting bracket secured to an outer face of each end wall above the respective ends of the feeder apparatus, a selected end gate matching the selected feeder insert extending through the respective mounting brackets such that the lower edge of the end gate forms a V-shaped, upwardly indented or downwardly projecting slot with the opposing upper face of the selected feeder insert, and a releasable fastener member extending through the mounting bracket for securing the end gate at a selected height above the opposing face of the feeder insert.

12. The apparatus as claimed in claim 11, further comprising a plurality of flat panels of flexible material each having at least a first end edge having a V-shaped indent or projection of shape and angle matching the shape and angle of the end edge of a respective end gate, a selected matching pair of end gates and flat flexible panels extending through the mounting bracket with the flexible panel behind the end gate, and the first end edge of the flexible panel extending below the end edge of the end gate to provide a scraper to scrape excess joint compound from the corner bead.

13. The apparatus as claimed in claim 12, wherein each flexible panel has opposite end edges each having a matching V-shaped indent or projection.

14. The apparatus as claimed in claim 7, wherein each feeder insert comprises a solid block of material having a flat lower wall for engagement with the flat base of the channel, the channel base having at least one opening and the lower wall of the feeder insert having at least one bore for alignment with said opening, the fastener device comprising a fastener member for extending through said opening and into said bore for releasably securing the insert in the channel.

15. The apparatus as claimed in claim 7, wherein each feeder insert has a generally flat lower portion for seating in the base of the channel, the lower portion having at least one bore, the channel base having at least one opening for alignment with said bore, and the fastener device comprises a fastener member for extending through said opening and into said bore for releasably securing the insert in the channel.

16. The apparatus as claimed in claim 15, wherein the bore is threaded and the fastener member comprises a fastener screw.

17. The apparatus as claimed in claim 15, wherein each feeder insert is a hollow member having opposite side walls and an open lower wall, at least one transverse web extending between the side walls, the transverse web having a lower edge comprising part of said generally flat lower portion and the bore extending into said transverse web from said lower edge.

18. A hopper apparatus, comprising:

a hopper having an open upper end, a lower wall, and an interior for holding a quantity of joint compound, the lower wall of the hopper having an opening;

a feeder apparatus secured beneath the lower wall of the hopper, the feeder apparatus comprising an elongate channel having a flat base wall and opposite ends, and a plurality of different elongate feeder inserts for selectively mounting in the channel for guiding corner beads of different angles and shapes through the channel, each feeder insert having an upwardly facing surface of different cross-sectional shape from the other feeder inserts, and having a flat lower portion for seating against the flat base wall of the channel;

a fastener device releasably securing a selected feeder insert in the channel; and a plurality of end gates for releasably securing to the hopper above opposite ends of the channel, each end gate having a lower edge shaped to match the cross-section of the upwardly facing surface of a respective feeder insert, the lower edge of the end gate and the upper face of the selected feeder insert together forming a slot of shape matching the cross-sectional shape of a selected corner bead for guiding the corner bead through the feeder apparatus with upper faces of the corner bead facing the opening in the lower wall of the hopper, whereby joint compound flowing through the opening into the channel will be deposited on the upwardly facing surfaces of the corner bead.

19. The apparatus as claimed in claim 18, wherein the feeder inserts comprise a first set of outside inserts each having an upwardly facing, generally V-shaped indented groove extending along their length for guiding an outside corner bead through the feeder apparatus with the concave face of the corner bead facing the joint compound in the hopper, and a second set of inside inserts each having an upwardly facing, generally V-shaped ridge extending along their length with an apex facing the joint compound in the hopper for guiding an inside corner bead through the feeder with the convex face of the corner bead facing the joint compound in the hopper, the feeder inserts in each set having grooves and ridges of different angles and corner shapes matching those of a plurality of different inside and outside corner beads.

20. The apparatus as claimed in claim 19, wherein each set of inside and outside feeder inserts and matching end gates are provided in a range of different angles, the angles comprising at least 90 degrees and 135 degrees.

21. The apparatus as claimed in claim 18, wherein each set of inside and outside feeder inserts and matching end gates include inserts and end gate lower edges with sharp angled concave and convex apices and bullnose, rounded concave and convex apices.

22. The apparatus as claimed in claim 18, further comprising a first set of flexible panels for selectively securing at opposite ends of the channel above the selected feeder insert the respective end gate, the flexible panels comprising a first set of generally rectangular flexible panels having at least a first end edge with a convex, V-shaped projection, the first end edge angles and shapes matching the angles and shapes of respective feeder inserts of the first set, and a second set of generally rectangular flexible panels having at least a first end edge with an upwardly directed, generally V-shaped indent, the first end edge angles and shapes of the flexible panels of the second set matching the angle and shape of respective feeder inserts of the second set.

23. The apparatus as claimed in claim 22, wherein each flexible panel has a second end edge opposite the first end edge of matching angle and shape to the first end edge.

24. A method of applying drywall mud to inside and outside corner beads, comprising the steps of:

securing a selected outside feeder insert in a channel facing a supply of drywall mud in a hopper, the outside feeder insert having an upwardly facing, generally V-shaped indented groove extending along its length;

feeding a supply of outside corner bead of shape and angle matching that of the V-shaped indented groove from one end of the feeder insert and along the feeder insert and out through an exit slot at the opposite end of the feeder insert, with concave faces of the corner bead facing upwardly such that drywall mud is applied to the concave faces of the V-shaped corner bead and excess mud is scraped off at the exit slot, whereby the outside corner bead is ready for application to an outside corner;

removing the outside feeder insert from the channel when sufficient outside corner bead has been coated with drywall mud;

securing a selected inside feeder insert in the channel, the inside feeder insert having an upwardly facing, generally V-shaped ridge extending along its length;

feeding a supply of inside corner bead of shape and angle matching that of the V-shaped ridge from one end of the feeder insert and along the feeder insert to an exit slot at the opposite end of the inside feeder insert, the convex faces of the corner bead facing upwardly such that drywall mud is applied to the convex faces and excess mud is scraped off at the exit slot, whereby the inside corner bead is ready for application to an inside corner.

* * * * *